US005299278A

United States Patent [19]

Heller

[11] Patent Number: 5,299,278

[45] Date of Patent: Mar. 29, 1994

[54] FORCED AIR CIRCULATION ELECTRIC CONVECTION SPACE HEATING SYSTEM UTILIZING HEATED AIR DISCHARGE TO PREHEAT AIR TO BE HEATED

[76] Inventor: Kenneth E. Heller, Star Rte., Box 290, Fairview, Utah 84629

[21] Appl. No.: 702,414

[22] Filed: May 20, 1991

[51] Int. Cl.[5] ..... F24H 3/06; H05B 3/82; H05B 1/00

[52] U.S. Cl. ..... 392/358; 126/101; 165/122; 165/104.31; 237/16; 392/360

[58] Field of Search ..... 392/375-378, 392/356-360; 237/16-18; 126/101; 165/122, 104.31

[56] References Cited

U.S. PATENT DOCUMENTS

| | | | |
|---|---|---|---|
| 1,747,134 | 2/1930 | Posey | 237/17 |
| 1,907,357 | 5/1933 | Kovesdy | 392/358 |
| 1,943,612 | 1/1934 | Lake | 392/360 X |
| 2,166,509 | 7/1939 | Smith . | |
| 2,175,307 | 10/1939 | Peck | 392/357 |
| 2,197,298 | 4/1940 | Cobb | 392/358 X |
| 2,203,425 | 6/1940 | Welch | 392/358 |
| 2,343,147 | 2/1944 | Katsulos | 392/358 X |
| 2,344,812 | 3/1944 | Gill | 392/357 |
| 2,427,476 | 9/1947 | Schick | 392/358 X |
| 2,482,746 | 9/1949 | Crozier | 237/16 |
| 2,491,849 | 12/1949 | Broome | 392/358 |
| 2,497,184 | 2/1950 | O'Brien | 392/358 X |
| 3,277,275 | 10/1966 | Brusven | 392/359 |
| 3,681,567 | 8/1972 | Boecher | 392/358 |
| 3,852,567 | 12/1974 | Michaud et al. | 392/357 |
| 4,825,847 | 5/1989 | Perron | 392/358 X |
| 5,131,461 | 7/1992 | Szucs | 392/357 X |

*Primary Examiner*—Anthony Bartis
*Attorney, Agent, or Firm*—Thorpe North & Western

[57] ABSTRACT

An electric forced circulation space heating system has a first heat exchanger provided with electric heating elements for heating a heat exchange fluid, such as anti-freeze or oil, pumped through a closed loop including first flow passages of a second heat exchanger having second flow passages in heat exchange relationship with the first flow passages thereof. A blower forces room air through the second flow passages of the second heat exchanger to be heated by the heated liquid flowing through the first flow passages thereof. A third heat exchanger downstream of the second heat exchanger has first flow passages with an inlet receiving heated air from the second flow passes of the second heat exchanger and an outlet for discharge of the heated air into the space to be heated. The third heat exchanger has second flow passages having an inlet receiving room air to be heated and an outlet connected to the air inlet of the blower, to thereby allow the incoming room air to be preheated by the the heated air flow through the first flow passages of the third heat exchanger prior to discharge into the space to be heated.

11 Claims, 2 Drawing Sheets

FORCED AIR CIRCULATION ELECTRIC CONVECTION SPACE HEATING SYSTEM UTILIZING HEATED AIR DISCHARGE TO PREHEAT AIR TO BE HEATED

BACKGROUND OF THE INVENTION

1. Field

This invention relates generally to the heating, ventilation, and air conditioning apparatus and more specifically to an improved system for heating buildings and the like.

2. Prior Art

Many different ways are known in which buildings are heated to temperatures which make working, sleeping and general living conditions more comfortable. Among the furnace systems available for heating buildings and the like are those which utilize natural gas, heating oil, and electricity. Heretofore, electrical heating systems have been less widely used, this mainly due to the general characteristic that the electrical power required to heat a given space is more expensive than the amount of heating oil or natural gas needed to heat the same space. This economic concern is especially acute because of the desire all over the world to find more and better ways to conserve energy.

State of the art electrical heating systems typically include resistive heating elements which are heated directly by electrical current passing therethrough and over which air is blown by a fan or similar device to heat the air before circulation throughout the house or building. A characteristic associated with this type of system is that each time air is to be heated for circulation through the building, the electrical heating elements must first be heated to an appropriate temperature. Much energy is lost in continued reheating and cooling of the heating elements.

Perhaps the most common and most accessible form of power available in industrial countries is electrical power; thus, electrical power would be a preferred source of energy for a building heating system if not for the great expense involved in purchasing the thousands of kilowatt hours of power which must be purchased to heat even modest size buildings in some climates.

In the case of heating systems which consume either natural gas or heating oil, an open flame is often kept burning at all times in order to ignite a greater flame at any given time, which greater flame heats the air to be circulated. Two major problems are associated with a continuously burning flame, these being: first, a continuous flame, even when well insulated, constitutes a fire hazard not found in electrical systems; second, the continuous flame, often called a pilot, can be extinguished at inopportune times, thus requiring relighting. Inappropriate expungement of pilot flames is accomplished oftentimes by minor and seemingly insignificant occurrences such as minor clogging of a gas line or minor malfunctioning of a valve.

Therefore, there exists in the industry a legitimate need for an electrical heating system which is capable of heating a given volume of space in a house or other building wherein the costs associated with heating that space are comparable with, or less than, the use of natural gas or heating oil systems.

BRIEF SUMMARY AND OBJECTS OF THE INVENTION

Accordingly, it is a principal object of this invention is to provide an electrical heating system which can heat a given space at a price and efficiency comparable with that of heating that same space using natural gas or heating oil systems.

A further object of this invention is to provide an efficient system for heating houses and other similar buildings in which the most common form of household power is utilized.

Still another significant object of the present invention is to provide a heating system which is safe, highly efficient, easy to manufacture, install, and maintain, and which contains parts which are durable and long lasting.

Another object of the present invention is the provision of a heating system wherein no open flame is required.

These and other objectives are accomplished by the present invention embodied in a preferred heating system for heating a space which is powered by electricity. The present invention preferably includes a first heat exchanger for heating a liquid, the first heat exchanger having at least one heating element. Also preferably included is a second heat exchanger in which the heated liquid from the first heat exchanger heats air to be circulated to the space to be heated. A pump is included also by which the liquid is forced between the first and second heat exchangers and an air blower is provided by which air is forced into the second heat exchanger to be heated by the heated liquid and then out of the second heat exchanger to be distributed to the space to be heated. A third heat exchanger located downstream of the second heat exchanger preheats cold incoming air form the space to be heated before the incoming air reaches the blower. The heating element, or elements, is coupled to a power source, preferably electrical.

Any number of liquids can be used in the preferred embodiments of the present invention, including water, although it is preferred that anti-freeze or a low-flammable oil be used. These preferred liquids retain heat better than water and are thus more desirable. The heating elements may be conventional, for example, elements used in electric water heaters are desirable, although tubing constructed of virtually any heat conducting material such as copper, is suitable.

In use, incoming cold air is preheated in the third heat exchanger by heated air leaving the heating system. Meanwhile, the heating element, or elements, in the first heat exchanger are heated utilizing power from the power source. The liquid, which is surrounding the heating elements is thereby heated before being forced by the pump into the second heat exchanger. In the second heat exchanger, air forced in by the blower is heated through contact with channels in which the heated liquid is contained. The heated air is then forced by the blower through the third heat exchanger and then into a distribution system, which is well-known in the art, the distribution system dispensing the heated air to the spaces in the house or building to be heated. The liquid, which has been slightly cooled in the second heat exchanger is then returned by the pump to the first heat exchanger for reheating. The cycle is repeated as necessary and the heated air which is distributed through the building is kept at the desired temperature.

DESCRIPTION OF THE DRAWINGS

The above and other objects, features and advantages of the invention will become apparent from a consideration of the following detailed description presented in connection with the accompanying drawings in which.

DETAILED DESCRIPTION

Reference is now made to the drawings wherein like numerals are used to denote like components throughout.

Figure 1:
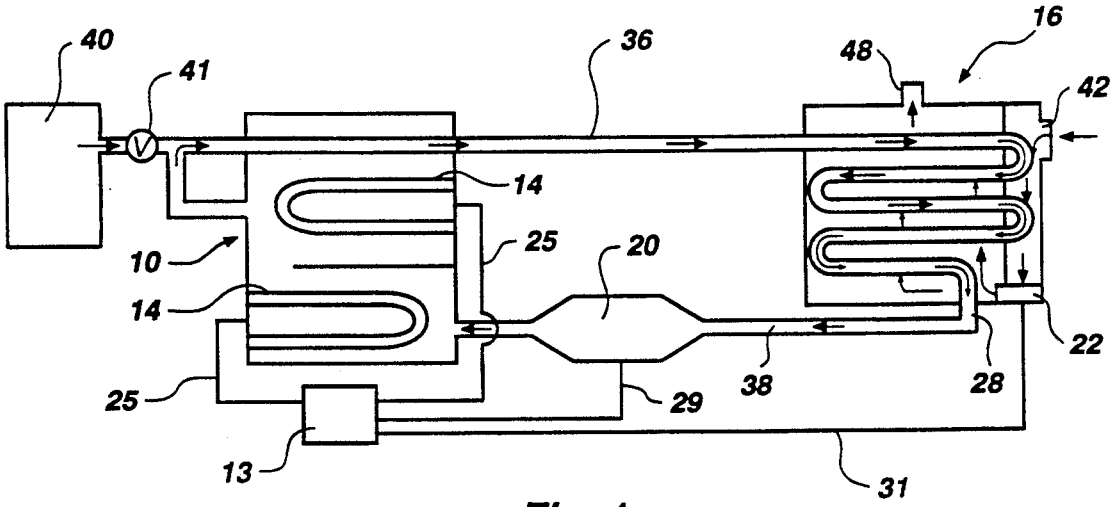
FIG. 1 is a schematic representation of the preferred embodiment of heating system, according to the principles of present invention.

Referring first to FIG. 1, the preferred embodiment of the improved heating system of the present invention comprises generally a first heat exchanger 10 for heating a liquid. The first heat exchanger 10 has at least on heating element 14. Also represented in FIG. 1 is a power source 13 coupled to each heating element 14.

A second heat exchanger 16, in liquid communication with the first heat exchanger 10, is provided for heating air with the heated liquid. A pump 20 is also shown, coupled to the power source 13 by which liquid is forced between the first and second heat exchangers 10 and 16, respectively. Also shown is an air blower 22 coupled to the power source 13 by which air is forced into the second heat exchanger 16 to be heated by the heated liquid and then out of the second heat exchanger 16 to be distributed to the space to be heated. Each of these components will be described hereafter in greater detail.

Figure 4:
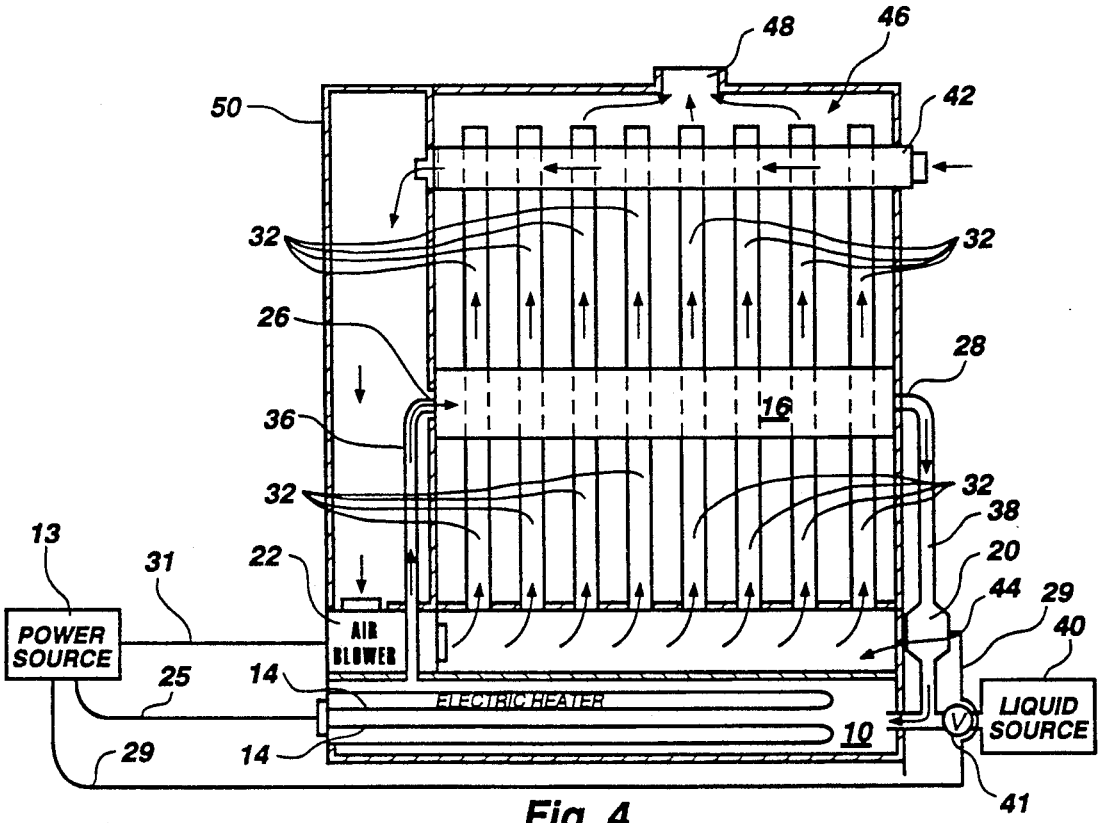
FIG. 4 is a partially cut-away, partially schematic representation of the embodiment of FIG. 1.

The preferred first heat exchanger 10 is a compartment, best shown in FIG. 1 and as first heat exchanger 10A in FIG. 4, in which the liquid is heated. As mentioned, this compartment contains at least one, and preferably a plurality of, heating elements 14. The heating elements 14 are securely mounted within the compartment in any known manner and each element 14 is constructed of a heat conducting material. Advantageously, each element 14 is a standard electric water heater element such as that available from Emerson Electric Company of Vernon, Alabama. This preferred element 14 is identified as catalog number SG1353 and is constructed of Chromalox®, this material being resistance wire surrounded by a ceramic material, which is itself covered by a metallic sheath.

Each of the elements 14 is coupled, by standard means such as an electric cord 25 and plug 27, to a power source 13. While other power sources fall within the purview of this invention, an electrical power source 13 is preferred. Advantageously, power source 13 is a standard household 240 volt AC power outlet.

The first heat exchanger 10 also contains a liquid which essentially surrounds the heating elements 14. The liquid may remain in transporting pipes or tubing, as discussed hereafter, or, as shown, may flow freely within the compartment. Heating elements 14 are sized according to the space constraints of the first heat exchanger 10.

Figure 3:
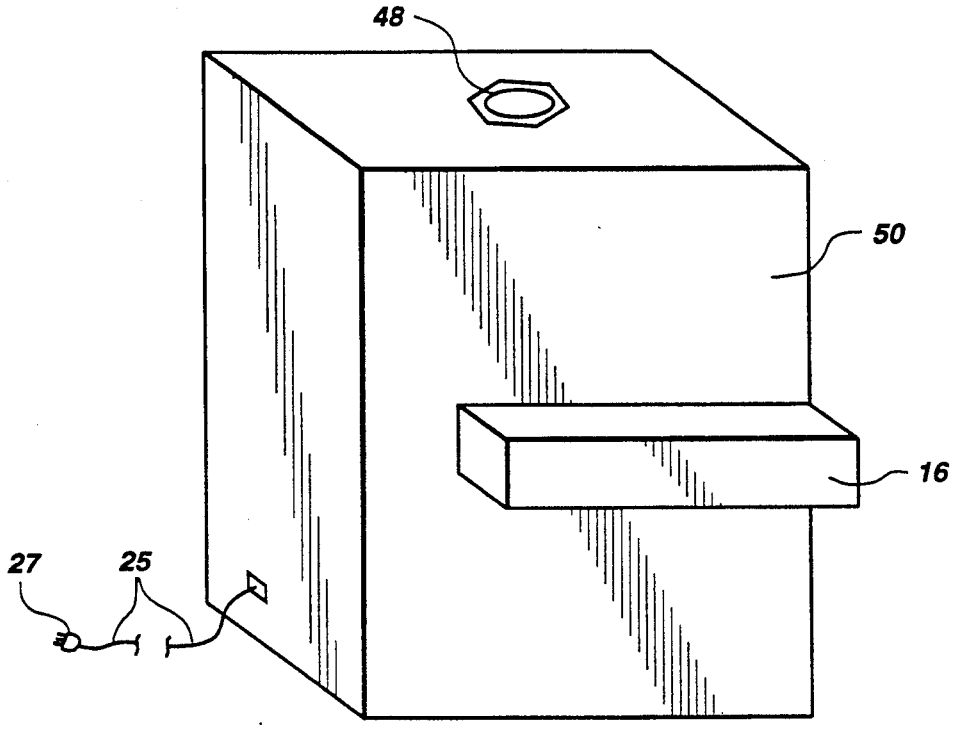
FIG. 3 is a three-dimensional perspective view of the invention illustrating the second heat exchanger of FIG. 2 partially removed.

The second heat exchanger 16A, as shown in FIG. 3, is advantageously removable from the remainder of the system. It is to be recognized, however, that a removable heat exchanger 16A may or may not be included in a preferred embodiment of this invention and does not change the scope thereof. Removal capabilities facilitate maintenance of the second heat exchanger 16A.

Figure 2:
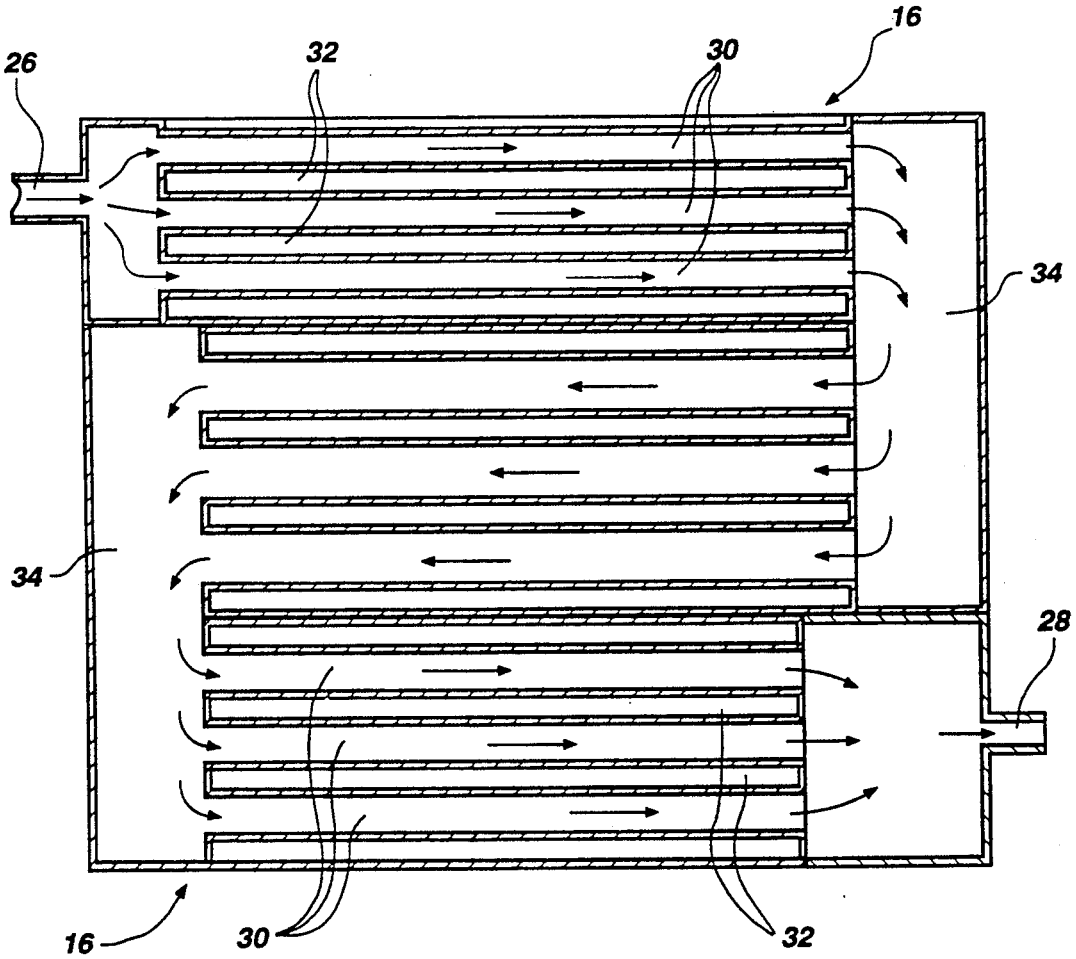
FIG. 2 is a sectional view of the second heat exchanger wherein air is heated by a heated liquid.

Referring now to FIG. 2, the second heat exchanger 16A is shown to have a liquid intake portion 26 and a liquid outtake portion 28. As illustrated, the liquid enters heat exchanger 16A through the liquid intake portion 26 before being separated into a plurality of flow passages 30, between which are disposed a plurality of air flow passages 32 through which the air to be heated is blown.

After flowing through the first series of flow passages 30, the liquid enters a pooling zone 34 where it reverses directions and enters a second series of flow passages 30. The liquid winds its way through several flow passages 30 and pooling zones 34 until the liquid, somewhat cooled, exits through liquid outtake portion 28 to be returned to the first heat exchanger 10 for heating. The number of flow passages 30 and pooling zones 34 to be included in second heat exchanger 16A is determined by the desired size thereof.

As best illustrated in FIG. 4, liquid intake portion 26, through which the liquid enters the second heat exchanger 16B is connected to and communicates with the first heat exchanger 10A by means of an insulated tube or pipe 36. Similarly, liquid outtake portion 28 is connected to and communicates with the first heat exchanger 10A by means of a second insulated tube or pipe 38, through which the somewhat cooled liquid returns from the second heat exchanger 16B to the first heat exchanger 10A reheating.

Alternatively, the tubes 36 and 38 could extend into the first heat exchanger and meet to provide a continuous tube wherein the liquid is contained. In this alternative, the portions of the tubes 36 and 38 contained within the first heat exchanger 10A adjacent to or even in contact with the heating elements 14 so as to facilitate heating of the liquid. It will be recognized that liquid contained in the tubes 36 and 38 will remain heated for some time even after the heating elements 14 are turned off.

Still referring to FIG. 4, a pump 20 is coupled to pipe 38 and is used to continuously circulates liquid between the first heat exchanger 10A the second heat exchanger 16B, through the flow passages 30 of the second heat exchanger 16B, in cyclic fashion. It will be recognized by one skilled in the art that the pump 20 may be placed in any other convenient location besides that shown, such as in pipe 36. Optionally, a liquid source 40 may be coupled to the first heat exchanger 10A or to pipe 38 to replenish liquid which dissipates or is otherwise lost in the system.

As seen, the liquid is contained in a closed loop system, which in theory prevents loss of any liquid. However, it has been found that a small percentage of some liquids, such as water, are lost during use, and therefore must be replenished. For this reason, liquid source 40 is optionally provided. A standard valve 4 can regulate the flow of liquid from the liquid source 40, as shown in FIGS. 1 and 4.

The pump 20 is a standard liquid pump, and is advantageously coupled to the same power source 13 which provides power to the heating elements 14 by a cord 29. The preferred pump is 1/20 horsepower and pumps a minimum of twenty-five gallons per minute. It will be readily recognized, however, that any number of other pumping devices fall within the scope of this invention.

An air blower 22 is provided which forces air 18 into the second heat exchanger 16B to be heated by the heated liquid and then expelled into a distribution system, not shown, to heat various spaces, as desired and needed. Preferred blower 22 is a standard blower found on any state of the art furnace. Advantageously, the blower 22 is powered by electricity and thus may be coupled in standard fashion to the power source 13, as shown, by a cord 31. See FIGS. 1 and 4. The air is brought into air blower 22 through a third heat exchanger 42 (42A in FIG. 4) and then expelled therefrom into a pooling zone 44 (44A in FIG. 4) thereafter to be forced into the parallel air passages 32 which pass through the second heat exchanger 16. The air is heated as it comes in contact with the flow passages 30 which contain the heated liquid in second heated exchanger 16. The air then pools together in a second pooling zone 46 before being expelled through an air outtake 48 which leads to the distribution system, not shown.

Advantageously, the third heat exchanger 42A is situated downstream of second heat exchanger 16B as shown in FIG. 4. Herein, cool air is brought into the third heat exchanger 42A through inlet 45 and passed between the air flow passages 32 without allowing the heated air contained therein to intermingle with the cool intake air brought in through inlet 45. This configuration partially warms incoming cool air the air before it is even conducted through outlet 47 to air blower 22, and ultimately to the second heat exchanger 16B. Heated air exiting the second heat exchanger 16B is conducted by flow passages 32 through the third heat exchanger 42A and then through air outtake 48 for discharge to the space to be heated. Thus, flow passages 32, as they pass through the third heat exchanger 42A, are an inlet for receiving heated air from the second heat exchanger 16B, and are also an outlet for discharging the heated air to the space to be heated.

As illustrated in FIGS. 3 and 4, most of the components described above are contained within a cabinet 50. Preferred cabinet 50 is constructed at least partially of a structural material, such as sheet steel which may be lined with an insulative material.

Although the preferred embodiment of the present invention has been illustrated and described, it is to be understood that the present disclosure is made by way of example and that various other embodiments are possible without departing from the subject matter coming within the scope of the following claims, which subject matter is regarded as the invention.

I claim:

1. An improved system for heating a space comprising a first heat exchanger for receiving and heating a liquid, and having at least one heating element for heating in response to a supply of power, a power source coupled to the heating element for supplying power thereto, a second heat exchanger having a first flow passage means having an inlet for receiving heated liquid from the first heat exchanger and a second flow passage means in heat exchange relationship with said first flow passage means, a pump for continuously circulating heated liquid from the first heat exchanger through said first flow passage means of said second heat exchanger and back to said first heat exchanger, an air blower having an air inlet and an air outlet, said blower having its outlet coupled to said second flow passage means of said second heat exchanger for forcing air through said second flow passage means of said second heat exchanger to be heated by heated liquid flowing through said first flow passage thereof for distribution to the space to be heated, and a third heat exchanger located downstream of said second heat exchanger and having a first flow passage means having an inlet arranged to receive the heated air from the second flow passage means of said second heat exchanger and an outlet discharging the heated air to the space to be heated, said third heat exchanger having a second flow passage having an inlet communicating with incoming cold air from the space to be heated and an outlet communicating with the inlet of said blower whereby the incoming cold air passing through the second flow passage means of said third heat exchanger is preheated by the heated air flowing through said first flow passage means of said third heat exchanger.

2. An improved system for heating a space according to claim 1 wherein each heating element is constructed of resistance wire surrounded by a ceramic material, said ceramic material being covered by metallic sheathing.

3. An improved system for heating a space according to claim 1 wherein the power source is electrical.

4. An improved system for heating a space according to claim 3 wherein the at least one heating element comprising a plurality of electrical resistance heating elements.

5. An improved system for heating a space according to claim 1 wherein the liquid comprises anti-freeze.

6. An improved system for heating a space according to claim 1 wherein the liquid comprises oil.

7. An improved system for heating a space according to claim 1 wherein the first floor passage means of said second heat exchanger comprises:

a first plurality of channels, a pooling zone in liquid communication with the first plurality of channels, and a second plurality of channels in liquid communication with the pooling zone.

8. An improved system for heating a space according to claim 1 wherein the second heat exchanger comprises a removable heat exchanger.

9. An improved system for heating a space according to claim 8 wherein the second flow passage means of said second heat exchanger comprises a plurality of air passageways.

10. An improved system for heating a space according to claim 1 further comprising means for replenishing the liquid.

11. A method of heating a space comprising the steps of receiving a liquid into a first heat exchanger, heating the liquid in the first heat exchanger using an electrical resistance heating element, continuously circulating the heated liquid from the first heat exchanger through a first flow passage means of a second heat exchanger, providing said second heat exchanger with a second flow passage means having an inlet for receiving air to be heated from a space and a heated air outlet, providing a third heat exchanger having a first flow passage means having an inlet and an outlet and a second flow passage means having an inlet and an outlet, communicating said outlet of said first flow passage means of said third heat exchanger to the inlet of said second flow passage means of said second heat exchanger for flow of room air through said first flow passage means of said third heat exchanger from said inlet thereof to the second flow passage of said second heat exchanger, communicating the outlet of said second flow passage means of said second heat exchanger to the inlet of said second flow passage means of said third heat exchanger whereby the incoming room air to be heated is preheated in the third heat exchanger by warm air already heated by the second heat exchanger, and pumping the cooled liquid from the first passage means of the second heat exchanger back to the first heat exchanger.

* * * * *